US009765780B2

(12) United States Patent
Komura et al.

(10) Patent No.: US 9,765,780 B2
(45) Date of Patent: Sep. 19, 2017

(54) COMPRESSOR

(71) Applicant: DENSO CORPORATION, Kariya (JP)

(72) Inventors: Masato Komura, Nishio (JP); Tadashi Hotta, Okazaki (JP); Toshiyuki Ebara, Nagoya (JP); Takashi Inoue, Okazaki (JP); Haruo Kamiya, Chiryu (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 269 days.

(21) Appl. No.: 14/389,132

(22) PCT Filed: Mar. 26, 2013

(86) PCT No.: PCT/JP2013/002042

§ 371 (c)(1),
(2) Date: Sep. 29, 2014

(87) PCT Pub. No.: WO2013/145713

PCT Pub. Date: Oct. 3, 2013

(65) Prior Publication Data

US 2015/0125330 A1 May 7, 2015

(30) Foreign Application Priority Data

Mar. 30, 2012 (JP) ..... 2012-081327

(51) Int. Cl.

| | |
|---|---|
| ***F01C 1/02*** | (2006.01) |
| ***F01C 1/063*** | (2006.01) |
| ***F03C 2/02*** | (2006.01) |
| ***F04C 2/02*** | (2006.01) |
| ***F04C 18/02*** | (2006.01) |
| ***F01C 21/18*** | (2006.01) |
| ***F04C 15/06*** | (2006.01) |

(Continued)

(52) U.S. Cl.
CPC ..... *F04C 15/062* (2013.01); *F04C 2/025* (2013.01); *F04C 18/0215* (2013.01);
(Continued)

(58) Field of Classification Search
CPC ..... F04C 15/06; F04C 29/042; F04C 29/128
(Continued)

(56) References Cited

U.S. PATENT DOCUMENTS 4,445,333 A * 5/1984 Coleman ..... B60T 11/22 137/513.3
5,076,067 A 12/1991 Prenger et al.
(Continued)

FOREIGN PATENT DOCUMENTS

EP 1936197 A1 6/2008
JP H04234592 A 8/1992
(Continued)

OTHER PUBLICATIONS

International Search Report and Written Opinion (in Japanese with English Translation) for PCT/JP2013/002042, mailed May 7, 2013; ISA/JP.

*Primary Examiner* — Deming Wan
(74) *Attorney, Agent, or Firm* — Harness, Dickey & Pierce, P.L.C.

(57) ABSTRACT

A check valve includes a valve seat portion and a reed valve element and is received in a receiving hole of an intermediate pressure refrigerant supply passage that is placed adjacent to a flow inlet of an injection port, through which a refrigerant of an intermediate pressure is injected into a compression chamber. A center of the flow inlet of the injection port is offset from a central axis of a valve seat passage formed in the valve seat portion.

12 Claims, 5 Drawing Sheets

(51) Int. Cl.
*F04C 29/12* (2006.01)
*F04C 29/04* (2006.01)
*F04C 23/00* (2006.01)

(52) U.S. Cl.
CPC ..... *F04C 29/042* (2013.01); *F04C 29/128* (2013.01); *F04C 23/008* (2013.01)

(58) Field of Classification Search
USPC ..... 418/55.1–55.5, 57, 270, 855, 856; 137/855, 856
See application file for complete search history.

(56) References Cited

U.S. PATENT DOCUMENTS 5,253,489 A 10/1993 Yoshii
5,329,788 A * 7/1994 Caillat ..... F04C 18/0215 418/55.5
5,722,257 A * 3/1998 Ishii ..... F04C 29/0035 418/55.5
6,113,369 A * 9/2000 Selway ..... F04B 39/1073 137/852
6,139,291 A * 10/2000 Perevozchikov ..... F04C 29/128 137/855
7,771,178 B2 8/2010 Perevozchikov et al.

FOREIGN PATENT DOCUMENTS

JP H04117195 U 10/1992
JP H11107949 A 4/1999
JP H11107950 A 4/1999
JP 2003074483 A 3/2003
JP 2008303858 A 12/2008
JP 2009287512 A 12/2009
JP 2011157895 A 8/2011

* cited by examiner

COMPRESSOR

CROSS REFERENCE TO RELATED APPLICATIONS

This application is a U.S. National Phase Application under 35 U.S.C. 371 of International Application No. PCT/JP2013/002042 filed on Mar. 26, 2013 and published in Japanese as WO 2013/145713 A1 on Oct. 3, 2013. This application is based on and claims the benefit of priority from Japanese Patent Application No. 2012-081327 filed on Mar. 30, 2012.

TECHNICAL FIELD

The present disclosure relates to a compressor that has a compression chamber, into which an intermediate pressure gas is injected.

BACKGROUND ART

As disclosed in, for example, Patent Literature 1, there is known a compressor that supercharges a compression subject fluid upon injection of the compression subject fluid into the compressor. Known electric compressors for refrigerating and air conditioning include an electric compressor having a compressing unit of a reciprocating type, an electric compressor having a compressing unit of a rotary type, and an electric compressor having a compressing unit of a scroll type. Among these types, the compressor of the scroll type has been practically used by utilizing the characteristics of the high efficiency, the low noise level and the low vibration level. In the compressor of the scroll type, a refrigerant gas of an intermediate pressure is injected through a check valve into a compression chamber formed between a stationary scroll and an orbiting scroll to implement the stable and efficient gas injection by utilizing the moderate compression that is the characteristic of the compressor of the scroll type. However, in a case where a path, which extends from the check valve to the compression chamber formed between the stationary scroll and the orbiting scroll, is complicated and is long, it is known that a dead volume becomes large to cause adverse influence on the compression efficiency, an increase in the amount of intrusion of a lubricating oil, unstableness of the lubrication caused by deterioration of draining, and unstableness of the performance.

In the prior art technique of Patent Literature 1, an injection port is formed in an end plate of the stationary scroll in such a manner that the injection port penetrates through the end plate from a back surface side of the end plate to the compression chamber in a wall thickness direction of the end plate. A block, to which an injection pipe is connected, is engaged with an outer surface of the end plate of the stationary scroll, which corresponds to the injection port, and a check valve chamber is formed between the end plate and the block. A reed valve element is fixed with bolts to a guide inlet of the block, which is connected with the injection pipe, to form a check valve. In this instance, the guide inlet of the injection pipe and the injection port are coaxially arranged. Furthermore, a valve stopper of the reed valve element is formed in a portion of the check valve chamber.

The prior art technique of Patent Literature 1 is the one that has a simple structure and a relatively small dead volume and can limit re-expansion of a compressible fluid and outflow of a lubricant oil. However, the following disadvantages (1)-(3) have been encountered.

(1) In the prior art technique, attention is not given to a relationship between a lifting direction of the reed valve element and a location of the injection port, so that depending on the positional relationship discussed above, a flow passage resistance may possibly become high, and an injection flow quantity may possibly be reduced. Furthermore, a size of the reed valve element is large. Therefore, when it is desirable to further reduce the dead volume, there will be a mounting difficulty.

(2) In the prior art technique, the bolts, which fix the reed valve element, are required. Therefore, the component costs are increased. Furthermore, the number of assembling steps is increased, and thereby the assembling costs are increased.

(3) Normally, in the case where the reed valve element is used, the valve stopper is required. In the prior art technique, there is the disclosure about the formation of the valve stopper, and the formation of the valve stopper requires a separate processing step, which is separate from a processing step of the refrigerant passage.

Besides the above prior art technique, Patent Literature 2 discloses a compressor of a refrigeration cycle, into which an intermediate pressure gas is injected. In Patent Literature 2, a reed valve element, which opens or closes in a direction perpendicular to an axial direction of an injection port that projects from a back surface of a stationary scroll, is inserted into the injection port, so that a dead volume cannot be reduced, and there is a disadvantage with respect to provision of an axial space. Patent Literature 3 recites a compressor, in which liquid injection is executed, and a plug is fitted into a connecting conduit, which is communicated with an injection port, to limit gasification of the liquid. In this compressor, a dead volume cannot be reduced when the dead volume of the entire flow passage is considered.

CITATION LIST

Patent Literatures

PATENT LITERATURE 1: JPH11-107950A
PATENT LITERATURE 2: JP2009-287512A
PATENT LITERATURE 3: JP2003-74483A
PATENT LITERATURE 4: JP2011-157895A

SUMMARY OF THE INVENTION

Problem to be Solved by the Invention

An objective of the present disclosure relates to the above disadvantages and is to provide a compressor, which has a compression chamber for receiving an intermediate pressure gas injected thereto, while the compressor can reduce a dead volume and can improve an injection characteristic.

Solution to Problem

A compressor according to the present disclosure has a housing that includes: a low pressure refrigerant supply passage that conducts refrigerant, which has a low pressure; a compression chamber that compresses the refrigerant supplied from the low pressure refrigerant supply passage to a high pressure, which is higher than the low pressure, and discharges the compressed refrigerant out of the compression chamber; and an intermediate pressure refrigerant supply passage that is communicatable with the compression chamber through an injection port to inject refrigerant, which has an intermediate pressure that is higher than the low pressure and is lower than the high pressure, into the compression chamber. The compressor has a check valve that is received in a receiving hole of the intermediate pressure refrigerant supply passage, which is placed adjacent to a flow inlet of the injection port. The check valve includes a valve seat portion and a reed valve element. The valve seat portion has a valve seat and a valve seat passage, and the valve seat passage is located radially inward of the valve seat and extends through the valve seat portion to conduct the refrigerant therethrough. A center of the flow inlet of the injection port is offset from a central axis of the valve seat passage. The reed valve element is seatable against the valve seat to close the valve seat passage and is liftable from the valve seat to open the valve seat passage. A check valve chamber is formed in the receiving hole at a location between the valve seat portion and a wall surface of the receiving hole to receive at least a portion of the reed valve element when the reed valve element is lifted from the valve seat.

DESCRIPTION OF EMBODIMENT

Figure 1:
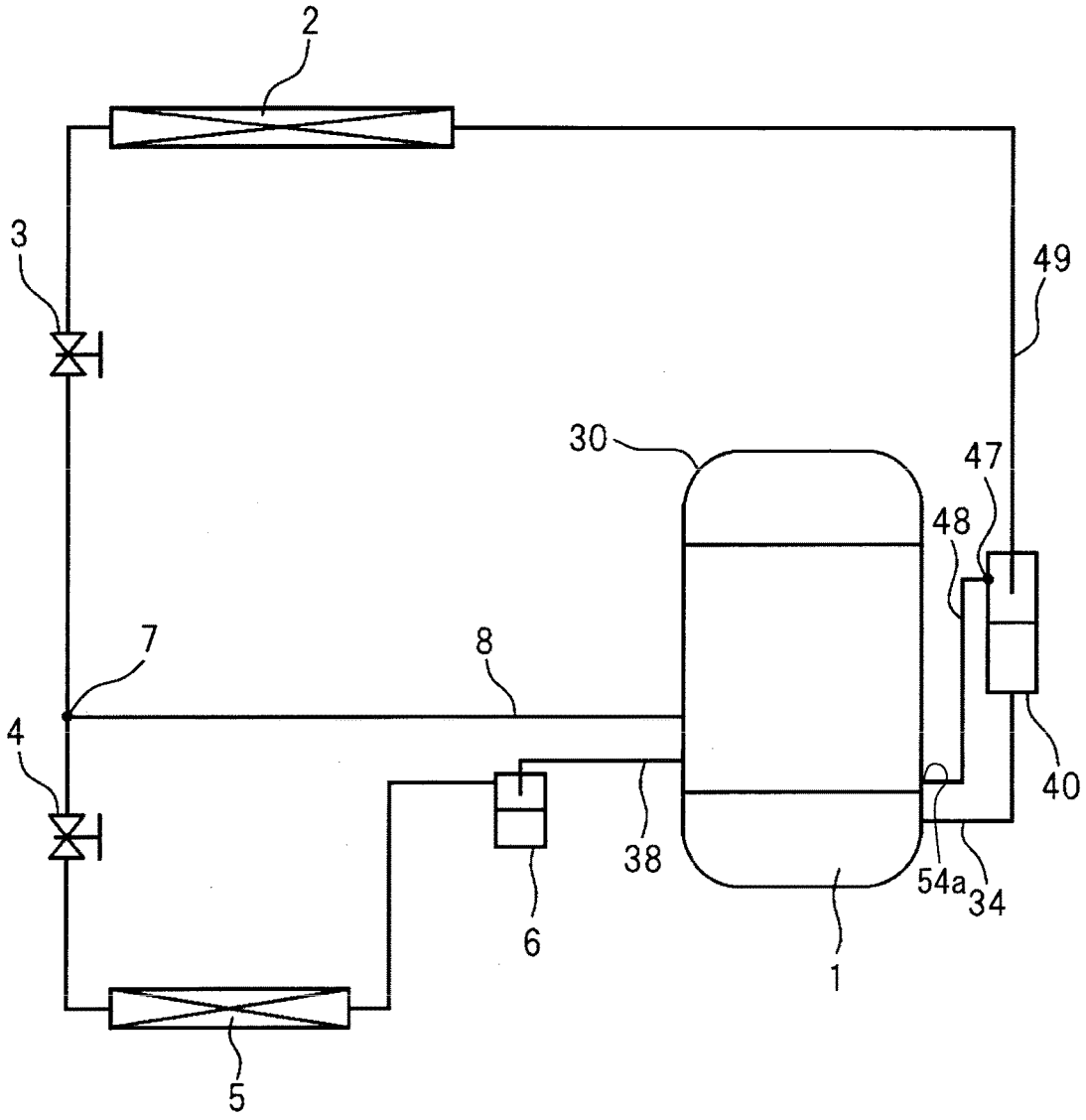
FIG. 1 is a descriptive view showing a heat pump cycle according to an embodiment of the present disclosure.

An embodiment of the present disclosure will be described with reference to the drawings. In the following embodiment and modifications thereof described below, similar components are indicated by the same reference numerals and will not be redundantly described.

The embodiment of the present disclosure is an example, in which a principle of the present disclosure is applied to a refrigeration cycle, more specifically, a heat pump cycle of a hot-water supply system. FIG. 1 is a descriptive view showing the heat pump cycle of the present embodiment. The heat pump cycle includes: a compressor 1, which suctions and compresses a refrigerant; a heat exchanger (a water refrigerant heat exchanger) 2, which exchanges heat between hot water and the refrigerant outputted from the compressor 1; a first expansion valve 3 and a second expansion valve 4, which depressurize the refrigerant outputted from the heat exchanger 2; a heat exchanger (evaporator) 5, which absorbs heat from external air to evaporate the refrigerant; and a gas-liquid separator 6, which separates the refrigerant outputted from the heat exchanger 5 into a liquid phase refrigerant and a gas phase refrigerant, wherein the gas-liquid separator 6 stores excessive refrigerant and supplies the gas phase refrigerant to the compressor 1 through a refrigerant conduit 38.

The heat pump cycle branches at a branch point 7, which is located on a downstream side of the first expansion valve 3 and on an upstream side of the second expansion valve 4, to supply the refrigerant gas of an intermediate pressure, which is once depressurized through the first expansion valve 3, to the compressor 1 through an intermediate pressure conduit 8. A refrigerant discharge passage 54 (see FIG. 2) of the compressor 1 is connected to a refrigerant inlet 47 of an oil separator 40 through a refrigerant outlet 54*a* and a refrigerant conduit 48. The oil separator 40 has a function of separating lubricant oil from the compressed refrigerant, which is discharged from a housing 30 of the compressor 1, and a function of returning the separated lubricant oil to the housing 30 through a conduit connecting member 34.

In the embodiment of the present disclosure, the principle of the present disclosure is applied to the heat pump cycle of the hot-water supply system. Alternatively, the principle of the present disclosure may be applied to other systems or a refrigeration cycle (including a heat pump cycle) of other apparatuses. For example, the principle of the present disclosure may be applied to a refrigeration cycle of a vehicle air conditioning system or a refrigeration cycle of other industrial or domestic air conditioners. Furthermore, the embodiment of the present disclosure describes an example, in which the principle of the present disclosure is applied to the compressor 1, which is constructed as a scroll compressor. However, the present disclosure is not limited to this, and the principle of the present disclosure may be applied to single stage compressors of other types. In addition, the principle of the present disclosure may be applied to a double stage compressor. Furthermore, in the heat pump cycle of the embodiment of the present disclosure, the gas-liquid separator 6 is provided on the downstream side of the heat exchanger 5. However, it should be noted that the principle of the present disclosure may be applied to a heat pump cycle that does not have the gas-liquid separator 6.

Figure 2:
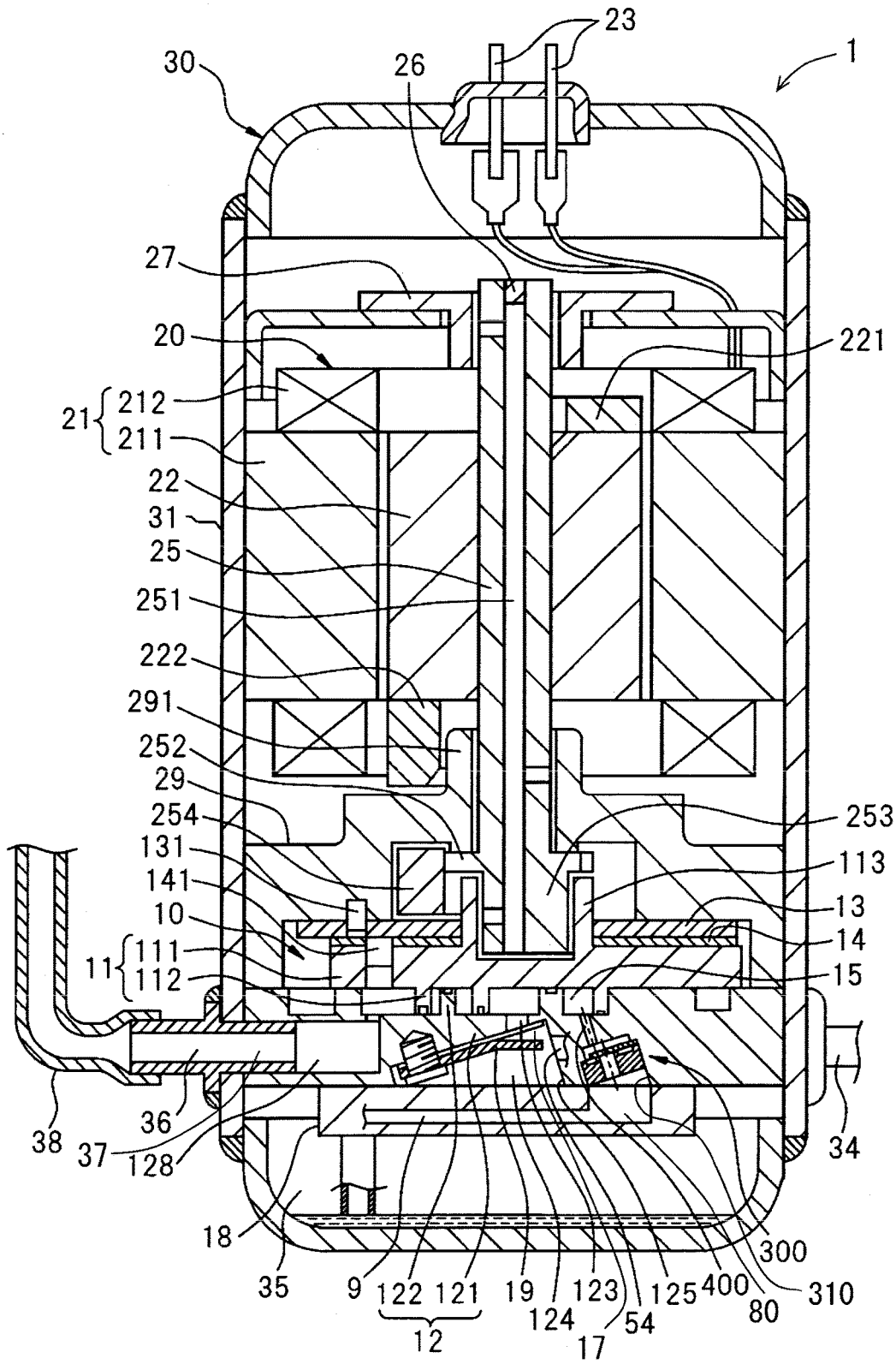
FIG. 2 is a cross-sectional view of a compressor of the embodiment of the present disclosure.

FIG. 2 is a cross-sectional view of the compressor 1 of the embodiment of the present disclosure. The compressor 1 is an electric compressor of a scroll type and includes a compressing mechanism 10, which compresses the refrigerant (refrigerant gas), and an electric motor device 20, which drives the compressing mechanism 10. The compressing mechanism 10 and the electric motor device 20 are arranged one after another in a top-to-bottom direction (vertical direction), so that the compressor of the present embodiment is formed as an upright type. In the present embodiment, although the compressor 1 is described as the upright type, the compressor 1 may be a horizontal type. The compressing mechanism 10 and the electric motor device 20 are received in the housing 30. The electric motor device 20 includes a stator 21 and a rotor 22. The stator 21 includes a stator core 211 and a stator coil 212, and the stator coil 212 is wound around the stator core 211.

An electric power is supplied to the stator coil 212 through power supply terminals 23. The power supply terminals 23 are placed at an upper end part of the housing 30. When the electric power is supplied to the stator coil 212, a rotating magnetic field is applied to the rotor 22 to generate a rotational force at the rotor 22, and thereby the rotor 22 is rotated together with the drive shaft 25. The drive shaft 25 is configured into a cylindrical tubular body, and an oil supply passage 251, which supplies the lubricant oil to slidable parts (lubrication subject parts) of the drive shaft 25, is formed in an interior space of the drive shaft 25. The oil supply passage 251 opens in a lower end surface of the drive shaft 25 and is closed by a closing member 26 at an upper end surface of the drive shaft 25.

A flange 252, which projects in a horizontal direction (a direction perpendicular to the axial direction), is formed in a portion of the drive shaft 25, which projects from the rotor 22 on the lower side of the rotor 22. A balance weight 254 is formed in the flange 252. Balance weights 221, 222 are also provided at upper and lower sides, respectively, of the rotor 22. The drive shaft 25 is supported by bearings 27, 291. A middle housing 29 is configured into a cylindrical tubular form having inner and outer diameters, which are increased in a stepwise manner from the upper side toward the lower side of the middle housing 29 in the top-to-bottom direction. An outer peripheral surface of the middle housing 29 is fixed to a tubular member 31 of the housing 30. An upper portion of the middle housing 29 forms the bearing 291. A movable scroll (also referred to as an orbiting scroll) 11, which serves as a movable member of the compressing mechanism 10, is received in a lower portion of the middle housing 29. A stationary scroll 12 of the compressing mechanism 10, which serves as a stationary member, is securely held on a lower side of the movable scroll 11. The movable scroll 11 is slidable relative to the stationary scroll 12.

The movable scroll 11 and the stationary scroll 12 has a movable scroll base plate portion 111 and a stationary scroll base plate portion 121, respectively, which are configured into a disk plate form. The movable scroll base plate portion 111 and the stationary scroll base plate portion 121 are opposed to each other in the top-to-bottom direction. A boss portion 113, which is configured into a cylindrical tubular form and receives a lower end part of the drive shaft 25, i.e., an eccentric portion 253, is formed in a center portion of the movable scroll base plate portion 111. The eccentric portion 253 is eccentric to a rotational center of the drive shaft 25.

A rotation limiting mechanism (not shown) is provided in the movable scroll 11 and the stationary scroll 12 to limit rotation of the movable scroll 11 about the eccentric portion 253. Therefore, when the drive shaft 25 is rotated, the movable scroll 11 revolves about a revolution center thereof, which is the rotational center of the drive shaft 25, without rotating about the eccentric portion 253. Two thrust plates 13, 14 are stacked one after another in the top-to-bottom direction at a location between the movable scroll 11 and the middle housing 29. The thrust plate 13 is positioned relative to the middle housing 29 by a positioning pin 131. The thrust plate 14 is fixed to the movable scroll 11 and is positioned relative to the movable scroll 11 by a positioning pin 141.

A spiral tooth (scroll wrap) 112 is formed in the movable scroll 11 to project from the movable scroll base plate portion 111 toward the stationary scroll 12. A spiral tooth (a scroll wrap) 122, which is meshed with the tooth 112 of the movable scroll 11, is formed in a top surface (a movable scroll 11 side surface) of the stationary scroll base plate portion 121. The spiral teeth 112, 122 of the scrolls 11, 12 are meshed with each other and contact with each other at a plurality of locations, so that a plurality of crescent shaped compression chambers 15 is formed. The refrigerant is supplied to each compression chamber 15 through a refrigerant inlet 36 and a refrigerant intake passage 128. The refrigerant inlet 36 and the refrigerant intake passage 128 form a low pressure refrigerant supply passage 37 that conducts the refrigerant gas, which has a low pressure, to the compression chamber 15. A refrigerant conduit 38 is connected to the refrigerant inlet 36. The refrigerant intake passage 128 of the stationary scroll base plate portion 121 is communicated with a radially outermost part of a spiral groove of the stationary scroll base plate portion 121 (a radially outermost part of the groove formed between the tooth 122 and an outer peripheral part of the stationary scroll base plate portion 121).

A discharge hole 123 is formed at a center part of the stationary scroll base plate portion 121 to discharge the refrigerant compressed in the compression chamber 15. A discharge chamber 124, which is communicated with the discharge hole 123, is formed in the stationary scroll base plate portion 121 at a lower side of the discharge hole 123. The discharge chamber 124 is defined by a recess 125, which is formed in the lower surface of the stationary scroll 12, and a partition member 18, which is fixed to a lower surface of the stationary scroll 12. A reed valve element 17 and a stopper 19 are placed in the discharge chamber 124. The reed valve element 17 serves as a check valve that limits backflow of the refrigerant to the compression chamber 15, and the stopper 19 limits a maximum opening degree of the reed valve element 17. The refrigerant of the discharge chamber 124 is discharged to an outside of the housing 30 through the refrigerant discharge passage 54, which is formed in the stationary scroll base plate portion 121, and the refrigerant outlet 54*a* (see FIG. 1), which is formed in a tubular member 31 of the housing 30.

As shown in FIG. 1, the refrigerant outlet 54*a* of the housing 30 is connected to the refrigerant inlet 47 of the oil separator 40 through a refrigerant conduit 48. The refrigerant, which enters the refrigerant inlet 47 of the oil separator 40, is guided to a cylindrical space of the oil separator 40 and forms a swirl flow of the refrigerant in the cylindrical space. Thereby, the lubricant oil is separated from the refrigerant by a centrifugal force generated by the swirl flow of the refrigerant. The oil separator 40 has the function of separating the lubricant oil from the compressed refrigerant, which is discharged from the housing 30, and the function of returning the separated lubricant oil to the housing 30 through the conduit connecting member 34. The refrigerant gas, from which the lubricant oil is separated, is supplied to the heat exchanger 2 through a refrigerant conduit 49.

A stationary side oil supply passage (not shown) is formed in an inside of the stationary scroll base plate portion 121. A movable side oil supply passage (not shown) is formed in an inside of the movable scroll base plate portion 111 to intermittently communicate with the stationary side oil supply passage at the time of orbital movement (revolution) of the movable scroll 11. The lubricant oil, which is outputted from the oil separator 40, is supplied to a location between the stationary scroll base plate portion 121 and the movable scroll base plate portion 111 through the conduit connecting member 34. Thereafter, this lubricant oil is supplied to a location between the eccentric portion 253 and the boss portion 113 of the movable scroll 11 and is also supplied to the bearings 27, 291 and the like through the oil supply passage 251. An oil reserve chamber 35 is formed in a bottom portion of the housing 30.

The supply and discharge passages of the refrigerant, and the supply passage of the lubricant oil discussed above are indicated as examples and are not limited to the above-described ones. That is, the supply and discharge passages of the refrigerant and the supply passage of the lubricant oil may be changed to other known modifications. The compressor 1 of FIG. 2 is basically the same as the compressor recited in Patent Literature 4 except an injection mechanism (also referred to as an injection device) discussed later. Therefore, explanation of the compressor 1 will be partially omitted.

Figure 3:
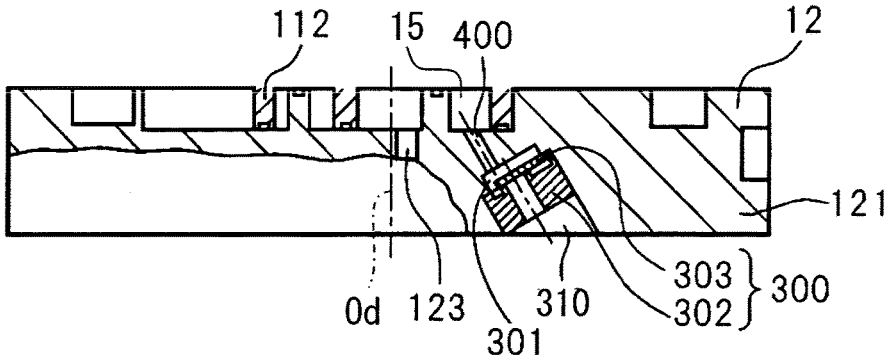
FIG. 3(*a*) is cross-sectional view showing an area around a compression chamber of the compressor according to the embodiment of the present disclosure, and FIG. 3(*b*) is an enlarged front cross-sectional view of an area around a reed valve element, and FIG. 3(*c*) is a plan view of the reed valve element.
Figure 3:
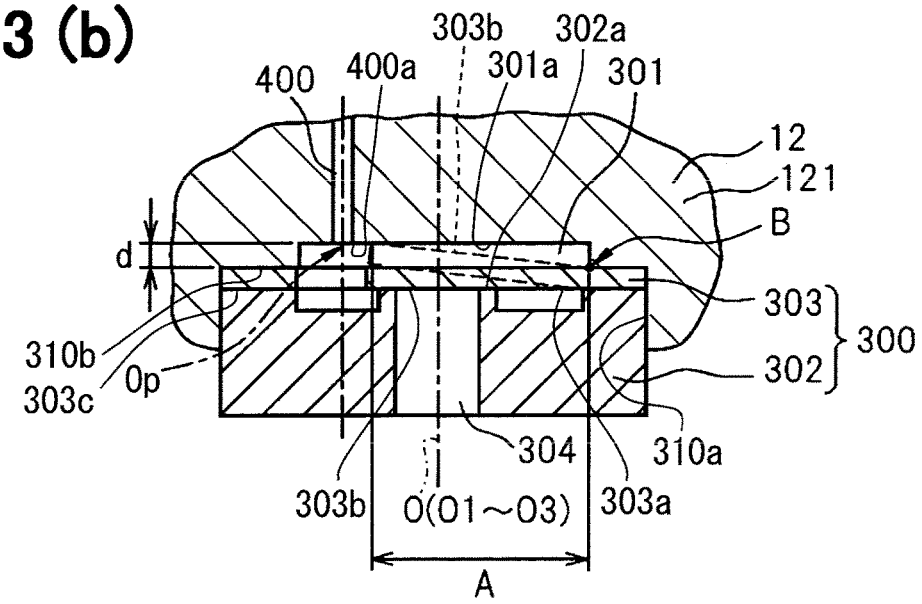
Figure 3:
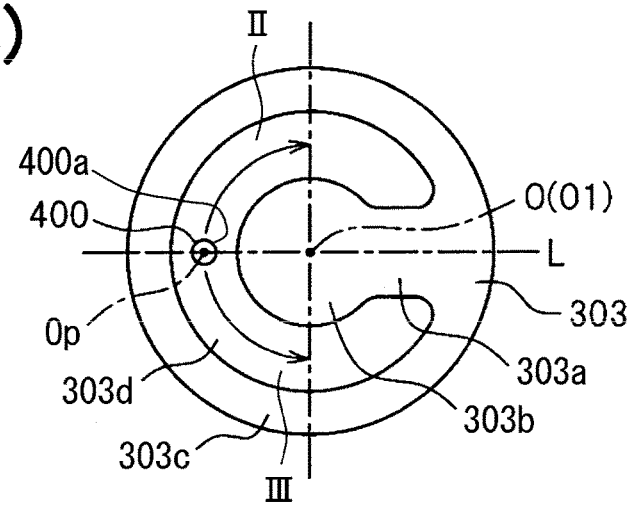

Next, the injection mechanism, which injects the intermediate pressure gas into the compression chamber of the compressor, will be described. FIG. 3(*a*) is a cross-sectional view showing an area around the compression chamber of the embodiment of the present disclosure. FIG. 3(*b*) is an enlarged front cross-sectional view of an area around the reed valve element. FIG. 3(*c*) is a plan view of the reed valve element.

In a case where the intermediate pressure gas is injected into the compression chamber of the compressor, particularly, when carbon dioxide is used as the refrigerant, it is demanded to have a high ratio of specific heat, a high gas density, a reduced dead volume and improvement of inflow of the gas in a high efficiency operational range. In the present embodiment, a plurality of injection ports (hereinafter simply referred to as ports) 400, each of which injects the intermediate pressure refrigerant into the corresponding compression chamber 15, is formed in the stationary scroll base plate portion 121 of the stationary scroll 12. Each of the ports 400 and the surrounding portion thereof are constructed substantially identical to each other for all of the ports 400. Therefore, in the following discussion, only one of the ports 400 will be described. Furthermore, instead of the plurality of ports 400, it is possible to provide only one port 400, which injects the intermediate pressure refrigerant to a corresponding one of the compression chambers 15, if necessary. As shown in FIG. 3(*b*), the port 400 is radially offset from a valve seat passage 304 of a check valve 300 on an opposite side of the valve seat passage 304, which is radially opposite from a connecting portion 303*a* of the reed valve element 303.

The refrigerant (the intermediate pressure gas) to be injected into the compression chamber 15 is guided from the branch point 7 of FIG. 1 into the interior of the compressor 1 through the intermediate pressure conduit 8. The intermediate pressure conduit 8 is connected to a passage 9, which is formed in the partition member 18 of FIG. 2, and the intermediate pressure is supplied to the port 400 through the check valve 300 that is press fitted into a receiving hole 310 formed in the stationary scroll base plate portion 121. The passage 9 and the receiving hole 310 and the port 400 provided in the stationary scroll base plate portion 121 form an intermediate pressure refrigerant supply passage 80, which supplies the intermediate pressure gas (the refrigerant gas) having the intermediate pressure to the compression chamber 15. The pressure of the intermediate pressure gas, which is supplied to the passage 9 through the intermediate pressure conduit 8, is higher than the pressure (intake pressure) of the low pressure refrigerant drawn into the refrigerant inlet 36 of the compressor 1 and is lower than a pressure (discharge pressure) of the high pressure refrigerant discharged from the refrigerant outlet 54*a* of the compressor 1. Here, in a case where the intake pressure and the discharge pressure are defined as a first pressure and a second pressure, respectively, the pressure of the intermediate pressure gas is higher than the first pressure and is lower than the second pressure. The check valve 300, which limits backflow of the refrigerant from the port 400 to the passage 9, is placed between the passage 9 and the port 400. The intermediate pressure gas is supplied to the compression chamber 15 through the check valve 300 and the port 400 in this order. A space between the compression chamber 15 and the check valve 300 becomes a dead volume. The presence of this volume may cause a re-expansion loss, so that it is desirable to minimize this volume.

FIGS. 3(*a*) to 3(*c*) show details of the check valve 300. In the present embodiment, the check valve 300 is placed at the closest possible position to the compression chamber 15. The receiving hole 310 is generally parallel to an extending direction of the port 400 and is recessed in a surface of the stationary scroll base plate portion 121, which is located on a side that is opposite from the compression chamber 15 in a top-to-bottom direction (an axial direction of a central axis Od of the drive shaft 25) in FIG. 3(*a*). In the present embodiment, the receiving hole 310 is formed as a circular hole that has a generally circular cross section. Furthermore, as shown in FIG. 2, the port 400 and the receiving hole 310 are formed in a limited area that is adjacent to the discharge chamber 124. Therefore, the extending direction of the port 400 and the extending direction of the receiving hole 310 are tilted relative to the axial direction of the central axis Od of the drive shaft 25. However, in a case where a sufficient area can be ensured immediately below the corresponding compression chamber 15, the port 400 and the receiving hole 310 may be formed at the area immediately below the compression chamber 15 such that the extending direction of the port 400 and the extending direction of the receiving hole 310 are generally parallel to the axial direction of the central axis Od of the drive shaft 25. The check valve 300 is press fitted into the receiving hole 310 and is located adjacent to a flow inlet 400*a* of the port 400. In this way, it is possible to shorten a length of the port 400 to reduce the dead volume. In order to minimize the dead volume of the port 400 up to the compression chamber 15, it is normally preferable that the port 400 is a linear flow passage, which connects to the compression chamber 15 with a minimum distance.

The check valve 300 includes a valve seat portion (also referred to as a valve seat member) 302 and the reed valve element 303. The valve seat portion 302 and the reed valve element 303 are formed as separate bodies, respectively, from metal (e.g., iron or iron alloy). At the time of assembling the check valve 300 to the receiving hole 310, the reed valve element 303 is press fitted into the receiving hole 310 up to a point, at which a circular outer peripheral seal portion 303*c* of the reed valve element 303 contacts a wall surface portion of the receiving hole 310, i.e., a seat portion 310*b* of the receiving hole 310. Next, the valve seat portion 302 is press fitted into the receiving hole 310 and is fixed in a state where the valve seat portion 302 contacts the reed valve element 303. In this way, the valve seat portion 302 is directly held in the state where the valve seat portion 302 contacts a valve seat portion holding section 310*a* of the receiving hole 310. The assembling method of the check valve 300 is not limited to this method, and the check valve 300 may be assembled by a different method. For example, a male thread may be formed in the outer peripheral surface of the valve seat portion 302, and a female thread may be formed in an inner peripheral surface of the receiving hole 310. In such a case, the male thread of the valve seat portion 302 is threadably engaged with the female thread of the receiving hole 310, and the valve seat portion 302 is urged against the reed valve element 303, which is inserted into the receiving hole 310, to fix the valve seat portion 302.

In the state shown in FIGS. 3(*a*) and 3(*b*) where the reed valve element 303 and the valve seat portion 302 are assembled into the receiving hole 310, a space of the receiving hole 310, which is located between the valve seat portion 302 and the flow inlet 400*a* of the port 400, forms a check valve chamber 301 that enables an opening operation and a closing operation of the reed valve element 303. At the time of lifting the reed valve element 303 away from a valve seat 302*a*, the check valve chamber 301 receives at least a portion (specifically, an opening and closing end portion 303*b*) of the reed valve element 303. In the present embodiment, a diameter of the check valve chamber 301, which is measured in a direction that is perpendicular to a central axis O of the valve seat passage 304, is set to be smaller than a diameter of the valve seat portion holding section 310*a* of the receiving hole 310. That is, a cross-sectional area of the check valve chamber 301 is set to be smaller than a cross-sectional area of the valve seat portion holding section 310*a*. With this setting, the seat portion 310*b*, to which the circular outer peripheral seat portion 303*c* of the reed valve element 303 contacts at the time of press-fitting the reed valve element 303 into the receiving hole 310, is formed in the inside of the receiving hole 310. When the check valve 300 is configured into the circular form, it will be convenient at the time of assembling. The configuration of the check valve 300 is not limited to the circular form and may be changed to another form, which is other than the circular form. As shown in FIG. 3(*c*), the reed valve element 303 is made of a single-piece plate, in which the opening and closing end portion 303*b* surrounded by a C-shaped (arcuate) gap 303*d* is formed in an inside of the circular outer peripheral seal portion 303*c*. The opening and closing end portion 303*b* is seatable against the annular valve seat 302*a*, which surrounds the valve seat passage 304 that extends through the valve seat portion 302 in a plate thickness direction of the valve seat portion 302, and the opening and closing end portion 303*b* is connected to the circular outer peripheral seat portion 303*c* through the connecting portion 303*a*. The reed valve element 303 opens the valve seat passage 304 when the opening and closing end portion 303*b* and the connecting portion 303*a*, which are adjacent to each other and are located within an extent indicated by a length A, are turned and lifted about a point, which is indicated by a reference sign B in FIG. 3(*b*) and serves as a rotational center, in the direction away from the valve seat 302*a*, as indicated by a dotted line in FIG. 3(*b*). A reference sign d of FIG. 3(*b*) indicates a lift amount of the reed valve element 303 (more specifically, the opening and closing end portion 303*b*) at this time point.

Normally, in order to reduce the dead volume, the lift amount of the reed valve element 303 (more specifically, the opening and closing end portion 303*b*) should be made as small as possible. However, when the refrigerant to be injected passes between the valve seat 302*a* and the reed valve element 303, the reed valve element 303, which is adjacent to the valve seat 302*a*, forms a flow passage resistance to possibly cause a reduction in the flow quantity. In the present embodiment, a central axis O2 of the valve seat portion 302 (more specifically, the valve seat 302*a*) and a central axis O1 of the reed valve element 303 (the circular outer peripheral seal portion 303*c*) are arranged such that the central axis O2 and the central axis O1 generally coincide with a central axis O3 of the check valve chamber 301. A center Op of the flow inlet 400*a* of the port 400, which is communicated with the compression chamber 15, is placed in a corresponding position, which is opposite from the connecting portion 303*a* of the reed valve element 303 in the radial direction and is offset from the central axis O of the valve seat passage 304. Therefore, when the opening and closing end portion 303*b* of the reed valve element 303 is opened upon lifting of the opening and closing end portion 303*b* from the valve seat 302*a*, as indicated by the dotted line in FIG. 3(*b*), the refrigerant gas is outputted to the left side in FIG. 3(*b*) through a gap between the opening and closing end portion 303*b* and the valve seat 302*a* and is inputted to the flow inlet 400*a* of the port 400. Thus, even when the lift amount d of the reed valve element 303 is made small, the flow passage resistance can be minimized. Particularly, the center Op of the flow inlet 400*a* of the injection port 400 is overlapped with a corresponding portion of the gap 303*d* in a direction that is parallel to the central axis O of the valve seat passage 304. This corresponding portion of the gap 303*d* is placed on a side of the central axis O of the valve seat passage 304 that is opposite from the connecting portion 303*a* in the radial direction of the reed valve element 303. Specifically, it is required to place the center Op of the flow inlet 400*a* of the port 400 in such a manner that the center Op of the flow inlet 400*a* is overlapped with a portion of the gap 303*d*, which is located in an area made of the second quadrant II and the third quadrant III in a case where the central axis O of the valve seat passage 304 of FIG. 3(*c*) is defined as an origin, and a sign L of FIG. 3(*c*) is defined as an X axis. In this way, it is possible to achieve the advantage of limiting the flow passage resistance discussed above.

Particularly, when the port 400 is placed on the opposite side, which is opposite from the connecting portion 303*a* of the reed valve element 303 in the radial direction, the gap between the reed valve element 303 (more specifically, the opening and closing end portion 303*b*) and the valve seat portion 302 (more specifically, the valve seat 302*a*) at the time of opening the reed valve element 303 is maximized, and thereby the refrigerant can flow into the port 400 from the side where the flow passage cross-sectional area is maximized. Thus, the pressure loss can be limited.

With the above construction, the flow passage resistance is reduced, and the re-expansion loss caused by the dead volume is reduced. Thus, the performance ratio (flow characteristics) can be improved by about 25%. The injection of the intermediate pressure gas into the compression chamber 15 is made for the purpose of increasing the quantity of the flow through the condenser (the water refrigerant heat exchanger), and this increase in the quantity of the flow can be about 25%.

In the embodiment discussed above, the central axis O1 of the reed valve element 303 (more specifically, the circular outer peripheral seat portion 303*c*), the central axis O2 of the valve seat portion 302, and the central axis O3 of the check valve chamber 301 are arranged to be generally coaxial to each other. In this way, a generally circular outer peripheral edge of the circular outer peripheral seat portion 303*c*, a generally circular outer peripheral edge of the valve seat portion 302, and a generally circular inner peripheral edge of the check valve chamber 301 become generally concentric to each other and can be easily processed. Here, it should be noted that the present embodiment can be implemented even in a case where the central axis O of the valve seat passage 304 does not coincide with the central axes O1-O3 in some cases as long as the center Op of the flow inlet 400*a* of the port 400 is offset from the central axis O of the valve seat passage 304. In the present embodiment, the central axis O2 of the valve seat portion 302 and the central axis O of the valve seat passage 304 are separately indicated. Although these axes normally, generally coincide with each other, these axes are separately indicated in order to include the case, in which these axes do not coincide with each other, in the scope of the present disclosure.

An outer diameter of the circular outer peripheral seat portion 303*c* of the reed valve element 303 is set to be slightly larger than an inner diameter of the receiving hole 310, so that the positioning of the reed valve element 303 can be achieved by the press fitting without using, for example, a bolt(s). Specifically, the circular outer peripheral seat portion 303*c* and the valve seat portion 302 can be fixed into the receiving hole 310 by the press fitting. In this way, the fixing element, such as the bolt(s), which was required in the prior art technique, is not required. Thereby, the costs can be reduced.

The present disclosure is not limited to the above embodiment, and the above embodiment can be appropriately modified within the scope of the present disclosure. For example, the above embodiment can be modified as follows.

Figure 4:
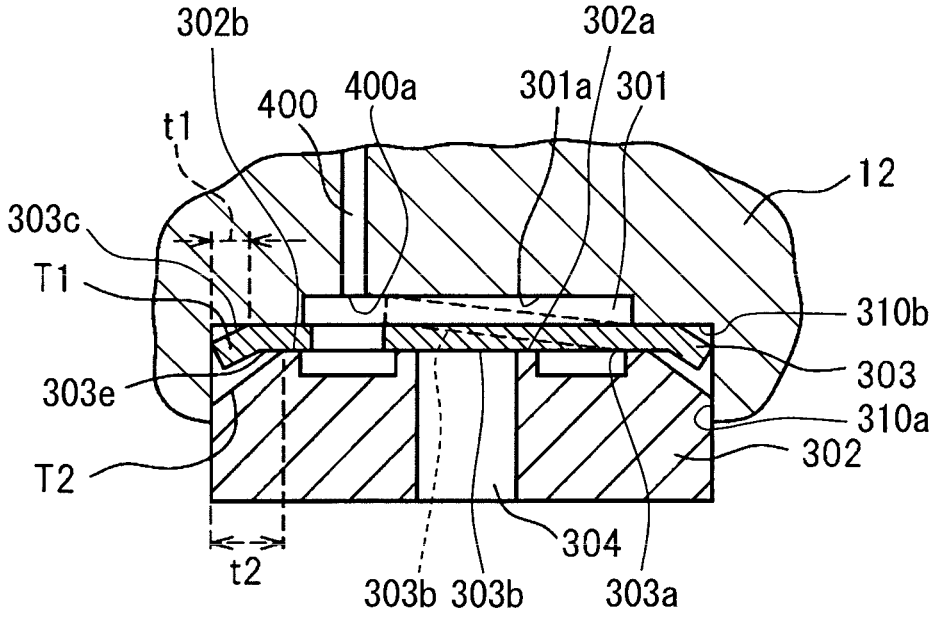
FIG. 4(*a*) is a cross-sectional view of an area around a reed valve element in a first modification of the embodiment of the present disclosure, and FIG. 4(*b*) is a cross-sectional view of the reed valve element of the first modification.
Figure 4:
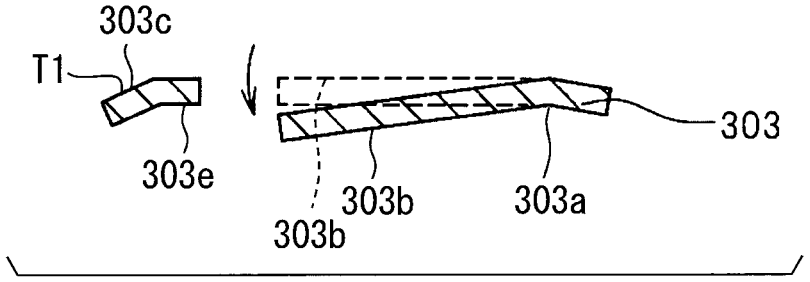

FIG. 4(*a*) is a cross-sectional view of an area around the reed valve element in a first modification of the embodiment of the present disclosure. FIG. 4(*b*) is a cross-sectional view of the reed valve element. A first tapered outer peripheral edge portion T1 is formed in the circular outer peripheral seat portion 303*c*, and a second tapered outer peripheral edge portion T2 is formed in the valve seat portion 302. Specifically, the first tapered outer peripheral edge portion T1 is formed in the circular outer peripheral seat portion 303*c*, and an outer diameter of the first tapered outer peripheral edge portion T1 progressively decreases in the axial direction of the central axis O of the valve seat passage 304 toward a side where the injection port 400 is located. Furthermore, the second tapered outer peripheral edge portion T2 is formed in an end part of the valve seat portion 302, which is located adjacent to the circular outer peripheral seat portion 303*c*, and an outer diameter of the second tapered outer peripheral edge portion T2 progressively decrease in the axial direction of the central axis O of the valve seat passage 304 toward the side where the injection port 400 is located. A radial inner end of the second tapered outer peripheral edge portion T2 contacts a corresponding part of the circular outer peripheral seat portion 303*c*, which is located on a radially inner side of a radial inner end of the first tapered peripheral edge portion T1. That is, the radial inner end of the second tapered outer peripheral edge portion T2 contacts a planar surface 303*e* of the circular outer peripheral seat portion 303*c*. A tilt width (a radial extent) t2, in which the second tapered outer peripheral edge portion T2 is formed, in the radial direction of the valve seat portion 302 is made larger than a tilt width (a radial extent) t1, in which the first tapered outer peripheral edge portion T1 is formed, in the radial direction of the reed valve element 303, so that the planar surface 303*e* of the circular outer peripheral seat portion 303*c* contacts a planar surface 302*b* of the valve seat portion 302. As shown in FIG. 4(*a*), when the tilt width t2 of the valve seat side is made larger that the tilt width t1, the insertability and the holdability of the reed valve element 303 are ensured. In a case where the relationship between the tilt width t1 and the tilt width t2 is reversed from the above-discussed relationship, the reed valve element 303 may possibly be bent or damaged.

When the taper is formed in the circular outer peripheral seat portion 303*c* of the reed valve element 303, warping of the valve is increased to possibly deteriorate the sealing performance. Thus, as shown in FIG. 4(*b*), the required sealing performance is maintained by previously bending the connecting portion 303*a*, at which the opening and closing end portion 303*b* is connected to the circular outer peripheral seat portion 303*c*, in an opposite direction that is opposite from the tapered portion. In this way, the required sealing performance of the reed valve element 303 is maintained. Furthermore, the assembling is eased, and the costs can be reduced.

Figure 5:
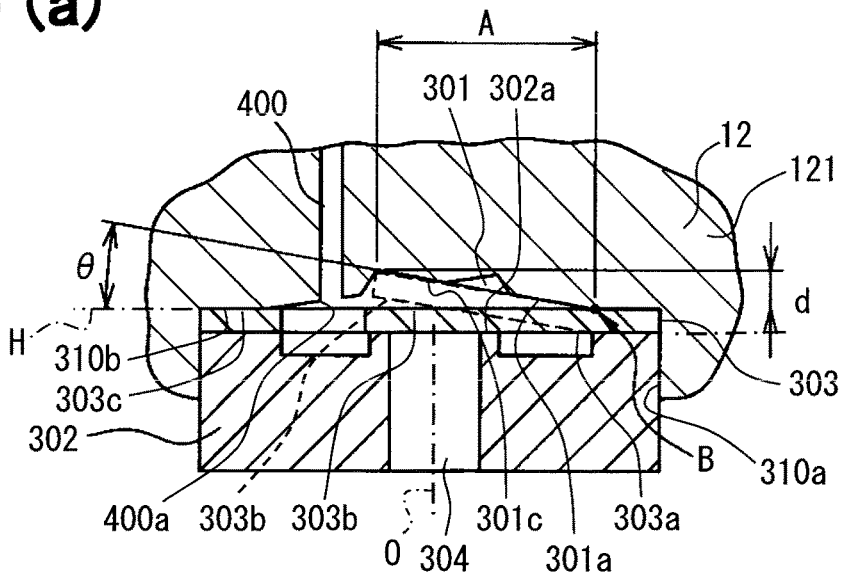
FIG. 5(*a*) is a front cross-sectional view of an area around a reed valve element in a second modification of the embodiment of the present disclosure, and FIG. 5(*b*) is a front cross-sectional view of a receiving hole, and FIG. 5(*c*) is a plan view of the reed valve element of the second modification.
Figure 5:
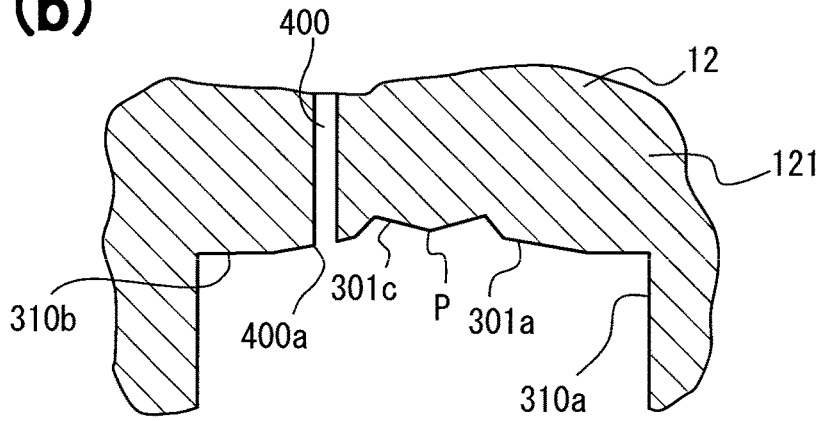
Figure 5:
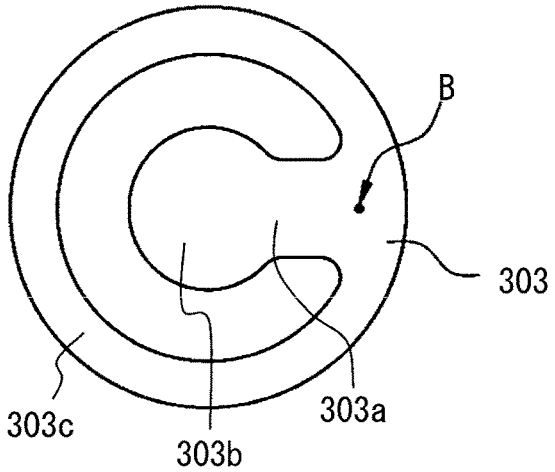

FIG. 5(*a*) is a front cross-sectional view of an area around the reed valve element in a second modification of the embodiment of the present disclosure. FIG. 5(*b*) is a front cross-sectional view of the receiving hole 310 of the second modification. FIG. 5(*c*) is a plan view of the reed valve element of the second modification. In this modification, as shown in FIGS. 5(*a*) and 5(*b*), a sloped surface 301*c*, which functions as a valve stopper at the valve opening time of the reed valve element 303, is formed in a bottom surface 301*a* of the check valve chamber 301 as a generally conical projecting surface that has an apex at a point P. As shown in FIG. 5(*a*), the opening and closing end portion 303*b* and the connecting portion 303*a* of the reed valve element 303 include the point B, which serves as the rotational center of the opening and closing end portion 303*b* and the connecting portion 303*a* at the time of lifting of the opening and closing end portion 303*b* and the connecting portion 303*a* away from the valve seat 302*a*. An angle of the sloped surface 301*c* relative to an imaginary plane H, which is perpendicular to the central axis O of the valve seat passage 304, is preferably set to be Tan $\theta$=0.05 to 1.0 (i.e., $0.05 \leq \text{Tan}\ \theta \leq 1.0$) and is more preferably set to be Tan $\theta$=0.05 to 0.5 (i.e., $0.05 \leq \text{Tan}\ \theta \leq 0.5$) in conformity with the operational pattern of the valve. In this way, the bottom surface 301*a* of the check valve chamber 301 forms the stopper, and thereby reduction of the number of the components and the implementation of the reliability of the reed valve can be ensured. Furthermore, the processing of the tapered configuration can be simultaneously performed at the time of processing the check valve chamber. Thus, in comparison to the prior art technique, which requires the separate processing, the costs can be reduced.

In the above embodiment and the modifications discussed above, the principle of the present disclosure is applied to the compressor of the scroll type. Alternatively, the principle of the present disclosure may be applied to another type of compressor (e.g., a compressor of a rotary type). At that time, the check valve 300 may be fixed by, for example, press fitting to a receiving hole that is formed in a stationary member (e.g., a cylinder of the compressor of the rotary type), which has a port communicated with a compression chamber.

What is claimed is:

1. A compressor, comprising:

a housing that includes:

a low pressure refrigerant supply passage that conducts refrigerant, which has a low pressure;

a compression chamber that compresses the refrigerant supplied from the low pressure refrigerant supply passage to a high pressure, which is higher than the low pressure, and discharges the compressed refrigerant out of the compression chamber; and an intermediate pressure refrigerant supply passage that is communicatable with the compression chamber through an injection port to inject the refrigerant, which has an intermediate pressure that is higher than the low pressure and is lower than the high pressure, into the compression chamber; and a check valve that includes a valve seat portion and a reed valve element and is received in a receiving hole of the intermediate pressure refrigerant supply passage, which is placed adjacent to a flow inlet of the injection port, wherein:

the valve seat portion has a valve seat and a valve seat passage, wherein the valve seat passage extends through the valve seat portion to conduct the refrigerant therethrough;

a center of the flow inlet of the injection port is offset from a central axis of the valve seat passage;

the reed valve element is seatable against the valve seat to close the valve seat passage and is liftable from the valve seat to open the valve seat passage;

a check valve chamber is formed in the receiving hole at a location between the valve seat portion and a wall surface of the receiving hole to receive at least a portion of the reed valve element when the reed valve element is lifted from the valve seat; and the reed valve element is abuttable against a bottom surface of the check valve chamber when the reed valve element is lifted away from the valve seat.

2. The compressor according to claim 1, wherein:

the reed valve element is formed as a single-piece plate and includes:

an opening and closing end portion that is seatable and liftable relative to the valve seat;

an arcuate gap that is located radially outward of the opening and closing end portion;

a circular outer peripheral seat portion that is located radially outward of the opening and closing end portion and the arcuate gap and has a generally circular outer peripheral edge; and a connecting portion that connects the opening and closing end portion to the circular outer peripheral seat portion.

3. The compressor according to claim 2, further comprising a central axis of the circular outer peripheral seat portion, a central axis of the valve seat portion and a central axis of the check valve chamber, all of which are generally coaxial to each other.

4. The compressor according to claim 2, wherein the circular outer peripheral seat portion of the reed valve element and the valve seat portion are securely press fitted into the receiving hole, which has a generally circular cross section.

5. The compressor according to claim 2, wherein:

a first tapered outer peripheral edge portion is formed in the circular outer peripheral seat portion such that an outer diameter of the first tapered outer peripheral edge portion progressively decreases in an axial direction of the central axis of the valve seat passage toward the side where the injection port is located;

a second tapered outer peripheral edge portion is formed in an end part of the valve seat portion, which is located adjacent to the circular outer peripheral seat portion, such that an outer diameter of the second tapered outer peripheral edge portion progressively decreases in the axial direction of the central axis of the valve seat passage toward the side where the injection port is located;

a radial inner end of the second tapered outer peripheral edge portion contacts a corresponding part of the circular outer peripheral seat portion, which is located on a radially inner side of a radial inner end of the first tapered peripheral edge portion; and a radial extent of the second tapered outer peripheral edge portion is larger than a radial extent of the first tapered outer peripheral edge portion.

6. The compressor according to claim 1, wherein a sloped surface is formed in the bottom surface of the check valve chamber and forms a stopper, to which the reed valve element is abuttable when the reed valve element is lifted away from the valve seat.

7. The compressor according to claim 6, wherein the sloped surface is tilted relative to an imaginary plane, which is perpendicular to the central axis of the valve seat passage, by a predetermined angle that satisfies the following condition:

$$0.05 \leq \tan\theta \leq 1.0$$

where $\theta$ denotes the predetermined angle of the sloped surface.

8. The compressor according to claim 2, wherein the center of the flow inlet of the injection port overlaps with a corresponding portion of the arcuate gap in a direction parallel to the central axis of the valve seat passage, and the corresponding portion of the arcuate gap is located on a radial side of the central axis of the valve seat passage, which is opposite from the connecting portion in a radial direction of the reed valve element.

9. The compressor according to claim 1, wherein the compressor is a scroll compressor.

10. The compressor according to claim 1, further comprising a stationary member, which is held stationary in the housing, and a movable member, which is slidable over the stationary member, wherein:

the compression chamber is formed between the stationary member and the movable member; and the receiving hole, which receives the check valve, and the injection port are formed in the stationary member.

11. The compressor according to claim 1, further comprising a cross-sectional area of the check valve chamber and a cross-sectional area of a valve seat portion holding section of the receiving hole, which contacts and holds the valve seat portion, wherein the cross-sectional area of the check valve chamber is smaller than the cross-sectional area of the valve seat portion holding section of the receiving hole.

12. The compressor according to claim 1, wherein the bottom surface of the check valve chamber is non-displaceable relative to the valve seat.

* * * * *